US008443642B2

(12) United States Patent
Golovashchenko

(10) Patent No.: US 8,443,642 B2
(45) Date of Patent: May 21, 2013

(54) PROCESS FOR PRE-FORMING CYLINDRICAL TUBES INTO TUBULAR MEMBERS HAVING SHARP CORNERS

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/277,275

(22) Filed: Oct. 20, 2011

(65) Prior Publication Data

US 2013/0098129 A1 Apr. 25, 2013

(51) Int. Cl.
*B21D 26/02* (2011.01)
*B21D 47/02* (2006.01)

(52) U.S. Cl.
USPC ..... 72/61; 72/62; 72/370.23; 29/421.1

(58) Field of Classification Search
USPC ..... 72/58, 59, 60, 61, 62, 370.23; 29/421.1
See application file for complete search history.

(56) References Cited

U.S. PATENT DOCUMENTS 2,205,893 A * 6/1940 Unger ..... 72/370.23
4,928,509 A * 5/1990 Nakamura ..... 72/61
6,098,438 A * 8/2000 Fischer ..... 72/60
6,151,940 A * 11/2000 Amborn et al. ..... 72/62
6,752,451 B2 * 6/2004 Sakamoto et al. ..... 72/61
6,763,693 B1 * 7/2004 Gehrig et al. ..... 72/61
6,810,705 B1 * 11/2004 Leppin et al. ..... 72/61
7,024,898 B1 * 4/2006 Zuber et al. ..... 72/61
7,827,840 B2 * 11/2010 Luckey et al. ..... 72/60
2009/0038428 A1 2/2009 Abe et al.
2010/0024503 A1 2/2010 Bradley et al.
2011/0097596 A1 4/2011 Mizumura et al.

OTHER PUBLICATIONS

S.D. Liu et al., Analytical and Experimental Examination of Tubular Hydroforming Limits, SAE Technical Paper Series, 980449, International Congress and Exposition, Detroit, Michigan Feb. 23-26, 1998.

* cited by examiner

*Primary Examiner* — David B Jones

(74) *Attorney, Agent, or Firm* — Damian Porcari; Brooks Kushman P.C.

(57) ABSTRACT

A method of forming a tubular member with portions having finished corners formed in a hydroforming operation by initially forming a pre-form that includes sharp corners. The pre-form includes bulges of the tube material between the sharp corners that flow toward the intended corner locations as the tubular member is hydroformed. The bulges may be external ribs or internal recesses.

18 Claims, 10 Drawing Sheets

PROCESS FOR PRE-FORMING CYLINDRICAL TUBES INTO TUBULAR MEMBERS HAVING SHARP CORNERS

TECHNICAL FIELD

This disclosure relates to forming tubular blanks into a tubular part that has one or more sharp corners.

BACKGROUND

Vehicle bodies are being manufactured from high strength, lightweight materials to reduce overall vehicle weight and improve fuel economy. Mild steel, the predominant structural material previously specified for vehicle structures, is ductile and does not tend to split easily when hydro-formed. Hydroforming cylindrical tubes made of lightweight materials such as aluminum and high strength steel alloys into tubular parts is often limited by the maximum strain in a local area causing splits, generally near a corner, while the rest of the tube may have very low levels of strain. The thickness of the part and the weight of the tube is increased to reduce the formation of splits when lightweight materials are hydro-formed. Using thicker tubes increases the material cost of the parts. Increasing the thickness of the tubes also limits weight reduction and results in reduced fuel economy.

Hydro-formed parts often have polygonal or rectangular cross-sections that require corners to be formed in a cylindrical tubular blank. High stress areas are generally located near the corners and hydro-formed parts made of lightweight materials may split near the corners resulting in scrapping parts.

The method disclosed addresses the problems associated with hydro-forming structural parts from lightweight materials as summarized below.

SUMMARY

One aspect of the disclosure is to introduce an additional step of pre-forming corners in a tubular blank in a pre-forming tool. This step changes the sequence of forming operations in hydroforming tubes. In the first forming step, sharp corners may be formed using a mandrel with sharp corners that is inserted inside the tube with external punches forming the tube around the inner mandrel. Alternatively, sharp corners may be formed by compressing the tube between a plurality of punches that may have convex forming surfaces that pinch the tubular blank to pre-form the sharp corners. The tube may be bent and then hydro-formed after forming the sharp corners.

Pre-forming sharp corners in the tubular blank lowers the strain level in the final part and enables lightweight materials with lower ductility and higher strength to be used in more applications leading to more weight reduction opportunities. Pre-forming sharp corners in a conventional die set lowers the level of pressure that is required in the hydroforming equipment and reduces the investment required for hydroforming tools and the cycle time of the hydroforming process.

Finite element analysis may be used to map areas of the cylindrical tubular blank that are later subjected to sharp bending to form sharp corners.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the present invention.

Figure 1:
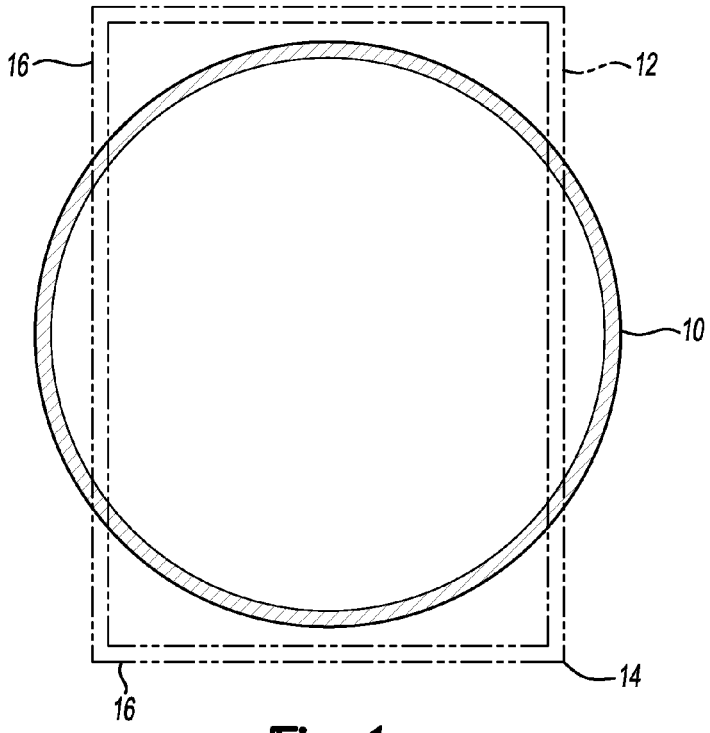
FIG. 1 is a diagrammatic view showing a tubular blank in conjunction with a phantom line drawing of a final rectangular tube member in cross section.

Referring to FIG. 1, a tubular blank 10 is shown in cross section and is overlaid on a diagrammatic cross-sectional view of a tubular member 12 shown in phantom lines that has final corners 14 that are relatively sharp and wall 16 extending between the corners 14. The periphery of the tubular blank 10 and perimeter of the tubular member 12 are intended to be approximately equal to minimize thinning and also to allow tubes with seams to be employed, as the tubular blank 10 is formed into the shape of the tubular member 12. It should be understood that the forming process may be limited to a portion of the length of the tubular blank 10 to reduce the extent of hydroforming required to form the tubular member 12. Some portions of the tubular blank 10 may remain circular, while other areas of the tubular member 12 are provided with flat walls and sharp edges to provide predetermined areas on the tubular member 12 to which parts, brackets and other members may be easily assembled.

Figure 2:
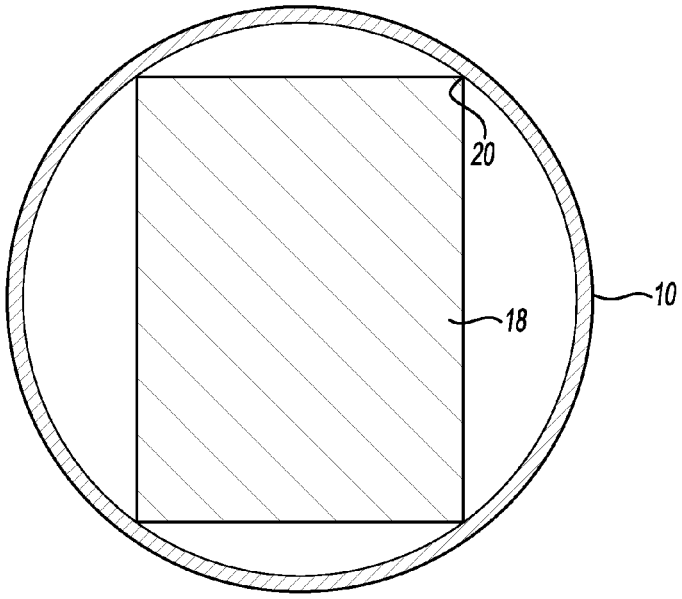
FIG. 2 is a cross-sectional view of a tubular blank with an internal mandrel disposed inside the tubular blank.

Referring to FIG. 2, an inner mandrel 18 is shown inserted within the tubular blank 10. The inner mandrel 18 includes pre-form corner edges 20 that are relatively sharp.

Figure 3:
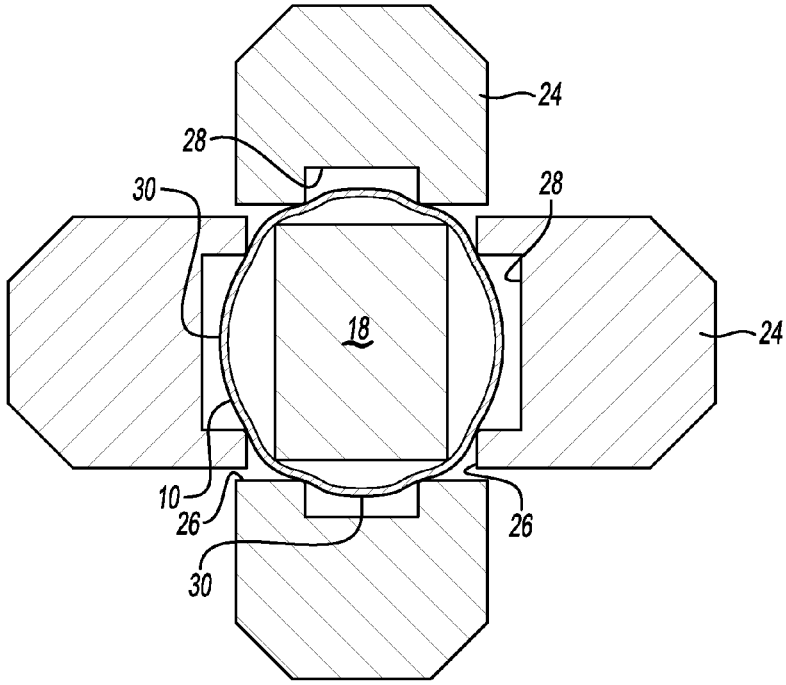
FIG. 3 is a cross-sectional view of the embodiment shown in FIG. 2 with four forming tools shown beginning to compress the tubular member against the inner mandrel.

Referring to FIG. 3, a tubular blank 10 is shown with an inner mandrel 18 and four forming tools 24. The forming tools 24 each have two corner forming surfaces 26 that are shown engaging the tubular blank 10. The forming tools 24 also have a bulge forming recess 28 that is provided to form a bulge 30 or a rib on one of the walls 16 of the tubular member 12.

Figure 4:
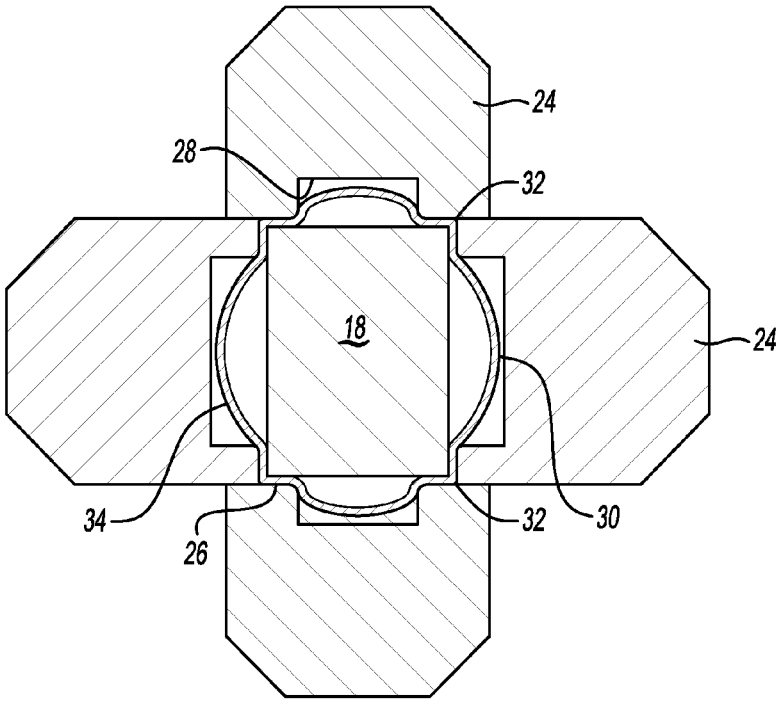
FIG. 4 is a cross-sectional view of the embodiment shown in FIG. 2 with four pre-formed corners formed against the mandrel by the four forming tools.

Referring to FIG. 4, the tubular blank 10, inner mandrel 18 and forming tools 24, as depicted in FIG. 3, are shown with the corner forming surfaces 26 fully forming pre-formed corners 32 against the pre-form corner edges 20 of the inner mandrel 18. A pre-form 34 is shown fully formed in FIG. 4 and includes bulges 30 that are formed into each of the bulge forming recesses 28.

Figure 5:
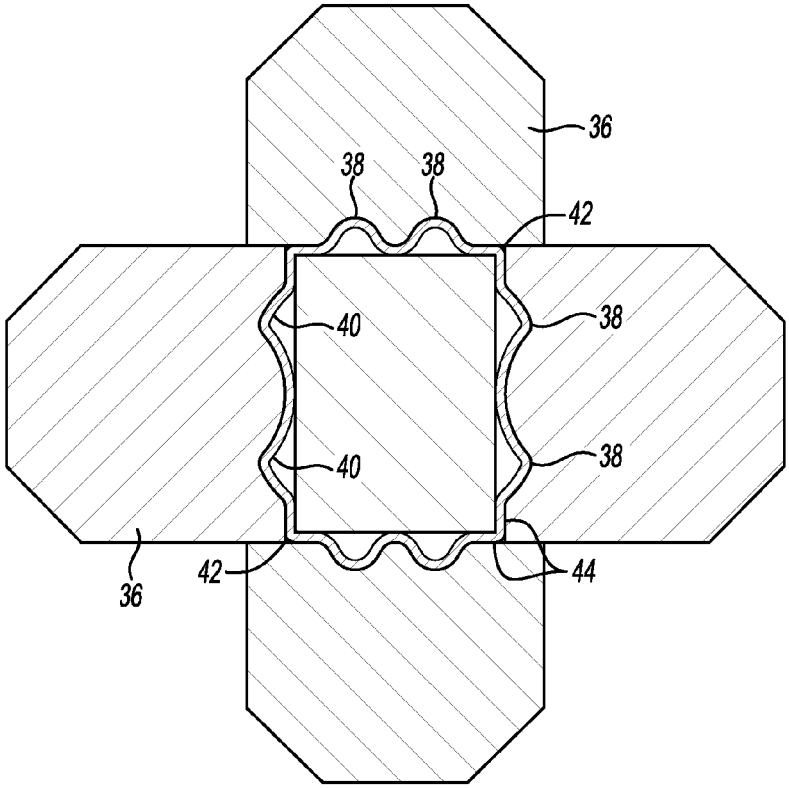
FIG. 5 is a cross-sectional view of an alternative embodiment with forming tools forming two bulges on each side of the internal mandrel.

Referring to FIG. 5, an alternative embodiment is shown in which double bulge forming tools 36 are shown after forming a tubular blank 10, as previously described with reference to the embodiment of FIG. 3. The double bulge forming tools 36 include dual recesses 38 into which bulges 40 are formed while the pre-formed corners 42 are formed by the double bulge forming tools 36. The walls 44 of the double bulge pre-form 46 include two bulges 40 between each of the pre-formed corners 42.

Figure 6:
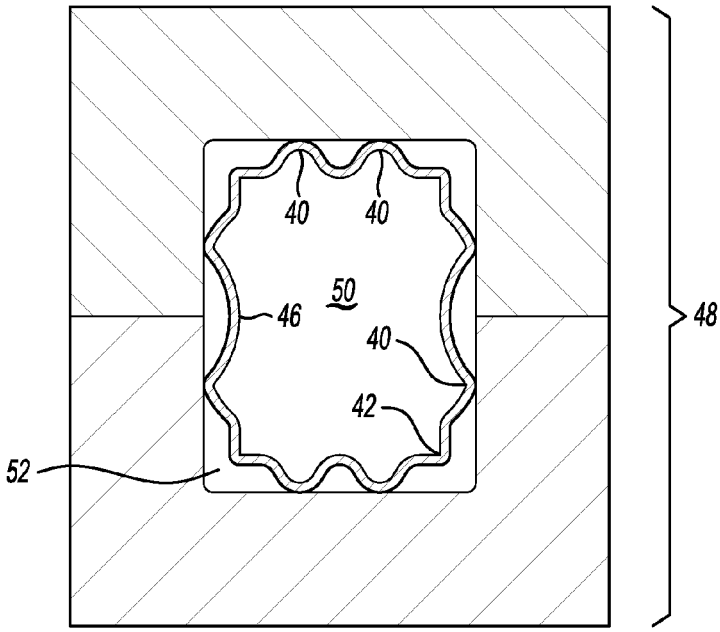
FIG. 6 is a cross-sectional view showing the pre-form made in FIG. 5 disposed in a hydroforming die.

Referring to FIG. 6, the double bulge pre-form 46 is shown in a hydroforming tool 48. The double bulge pre-form 46 includes sharply formed pre-formed corners 42 and a pair of bulges 40 on each of the sides and adjacent to each of the pre-formed corners 42. An interior space 50 is defined within the double bulge pre-form 46 and a clearance 52 is provided between the double bulge pre-form 46 and the hydroforming tool 48.

Figure 7:
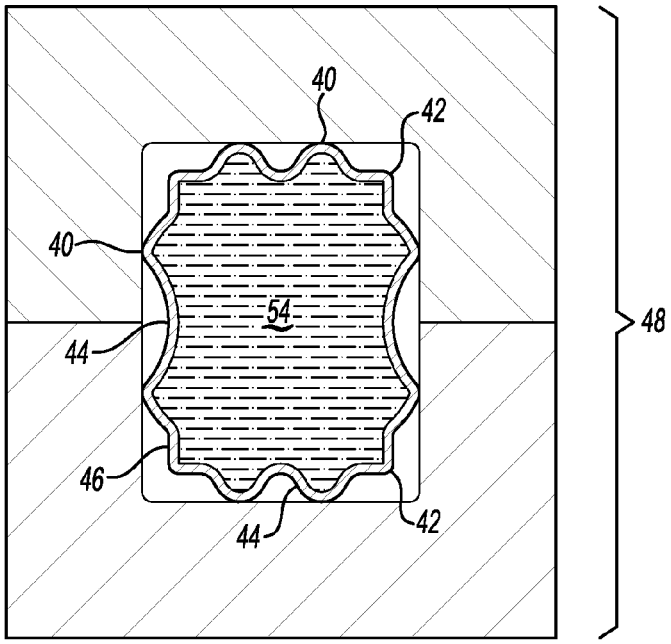
FIG. 7 is a cross-sectional view showing the pre-form of FIG. 5 filled with fluid prior to hydroforming.

Referring to FIG. 7, the hydroforming tool 48 is shown with the double bulge pre-form 46 inside the hydroforming tool 48. The pre-form is filled with a liquid 54 prior to actuating the hydroforming tool 48. The double bulge pre-form 46 includes bulges 40 adjacent to each of the pre-form corners 42 with two bulges being formed in each of the walls 44.

Figure 8:
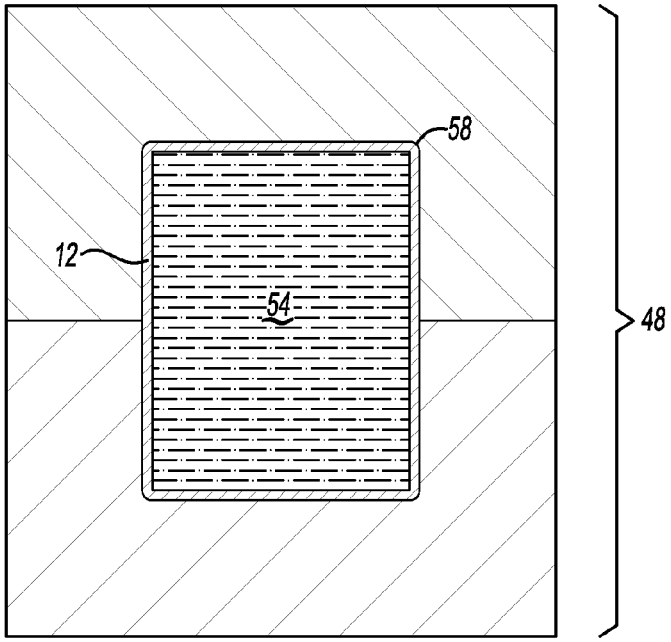
FIG. 8 is a cross-sectional view showing the final tubular member after hydroformed in a hydroforming die.

Referring to FIG. 8, the hydroforming tool is shown after the hydroforming operation with the fluid 54 having been pressurized to expand the double bulge pre-form 46 (shown in FIG. 7) into the shape of the tubular member 12 with sharp final corners 58.

The pre-form 34 shown in FIG. 4 may also be formed in a hydroforming tool 48. The description of FIGS. 7 and 8 below is equally applicable to the pre-form 34 shown in FIG. 4 by substituting pre-form 34 for double bulge pre-form 46. During hydroforming, the pre-form 34, shown in FIG. 4, is formed into the tubular member 12 with sharp corners 58, as shown in FIG. 8.

Figure 9:
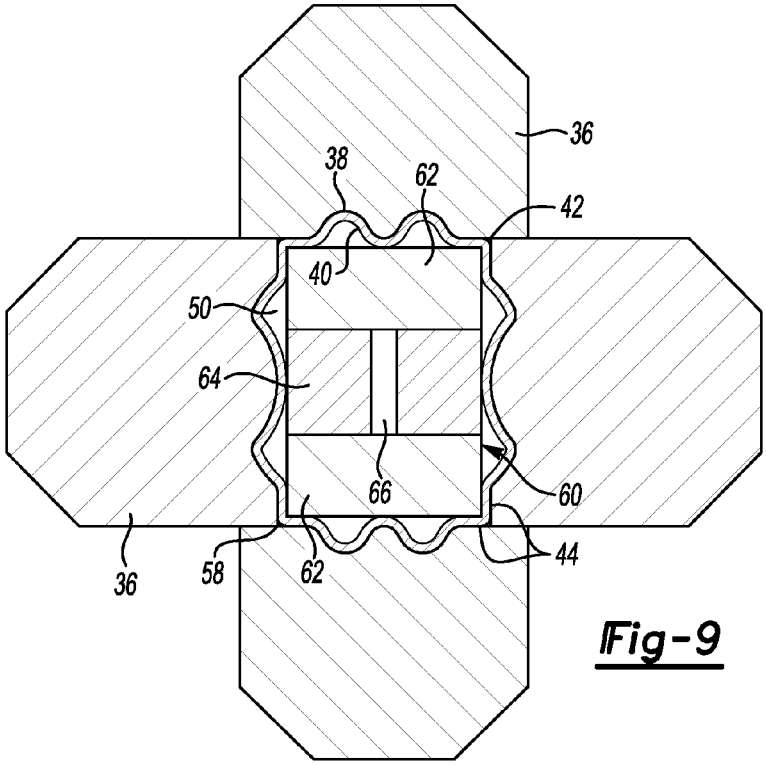
FIG. 9 is a cross-sectional view showing a pre-forming tool of FIG. 5 with a mandrel that can be disassembled into several parts and removed from the pre-formed tube.

Referring to FIG. 9, a multi-part inner mandrel 60 is shown within a fully formed double bulge pre-form 46 similar to that shown in FIGS. 5-8. The multi-part inner mandrel 60 includes two end pieces 62 and a center lock bar 64. The center lock bar 64 is inserted between the two end pieces 62. The center lock bar 64 includes a slot 66 that provides clearance for removal of the center lock bar 64.

Figure 10A:
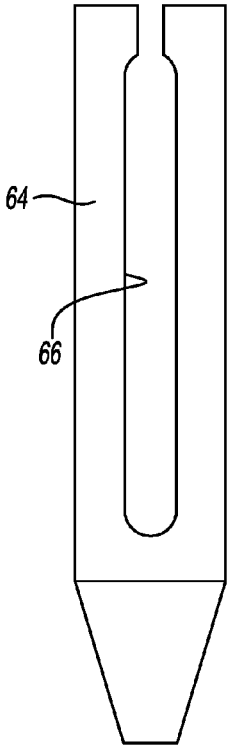
FIGS. 10A-10C are diagrammatic composite views showing a central portion and a single side of the dissassembable inner mandrel with a cross-sectional view thereof.
Figure 10B:
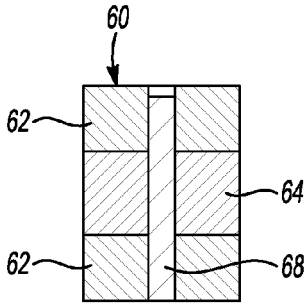
Figure 10C:
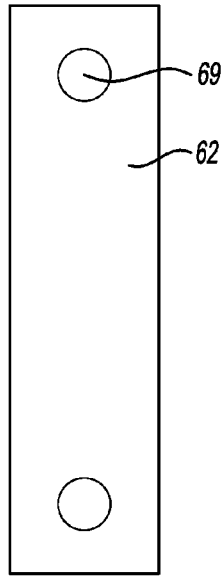

Referring to FIG. 10B, the multi-part inner mandrel 60 is shown in cross section with the two end pieces 62 and center lock bar 64 assembled together with a pin 68 being received in the slot 66 of the center lock bar 64. Referring to FIG. 10C, one end piece 62 is shown to include a pair of holes 69 that are adapted to receive one of the pins 68 shown in FIG. 10B. Referring to FIG. 10A, the center lock bar 64 is shown to include a slot 66 that extends through the center of the center lock bar 64. The pins 68 are disposed within the slot 66 when the center lock bar 64 is fully inserted into the multi-part inner mandrel 60.

The multi-part inner mandrel 60 may be disassembled by removing the center lock bar 64 to allow the end pieces 62 to be moved together to provide clearance between the double bulge pre-form 46 and the multi-part inner mandrel 60. In this way, the multi-part inner mandrel 60 may be easily removed from double bulge pre-form 46. Alternatively, it can be anticipated that spring-back in the blank may be sufficient to prevent the pre-forms 34 or 46 from becoming attached to the mandrel. In another alternative approach, fluid may be injected between the mandrels 18, 30 and the pre-forms 34, 46 to separate the mandrels from their respective pre-forms.

Figure 11:
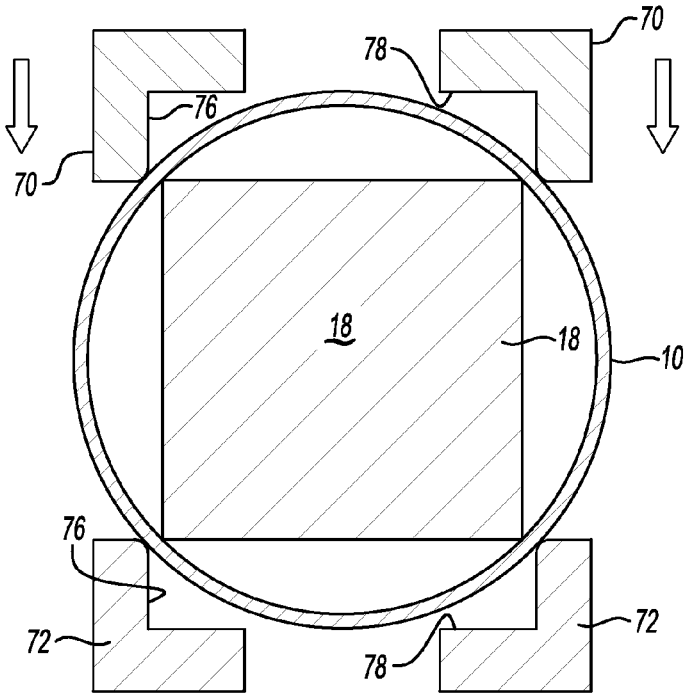
FIG. 11 is a cross-sectional view of a tubular blank with a square inner mandrel disposed within the tubular blank and four corner forming tools in position to compress a tubular member.

Referring to FIG. 11, a tubular blank 10 is shown in an alternative embodiment of a pre-form tool. The inner mandrel 18 is shown disposed in the tubular blank 10, as previously described. A pair of active corner forming tools 70 are shown on one side of the tubular blank 10 and a pair of static corner forming tools 72 are shown on the opposite side of the tubular blank 10. The corner forming tools each include a wiping surface 76 that wipes part of the tubular blank against the side of the mandrel 18 and a compression surface 78 that compresses a portion of the tubular blank against mandrel the 18.

Figure 12:
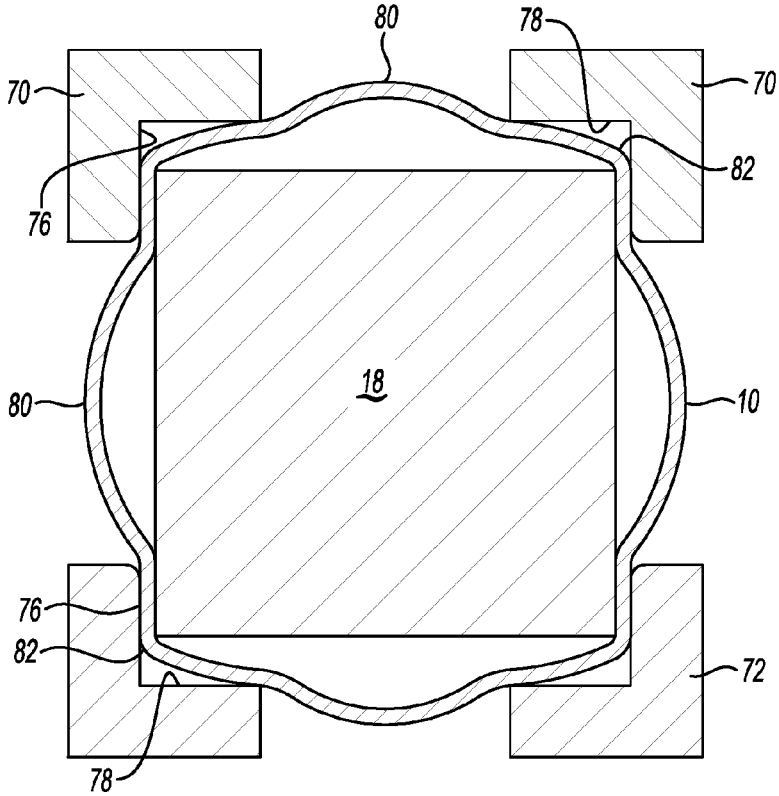
FIG. 12 is a cross-sectional view of the embodiment of FIG. 11 shown with the four forming tools partially compressing the tubular blank onto the inner mandrel.

Referring to FIG. 12, the tool shown in FIG. 11 is shown in an intermediate forming position in which the active corner forming tools 70 are shown forcing the tubular blank 10 and mandrel 18 into the static corner forming tool 72. The wiping surfaces 76 are shown with the tubular blank 10 being wiped onto the inner mandrel 18 in four locations. The compression surfaces 78 are shown compressing the tubular blank 10 toward the inner mandrel 18. External bulges 80 are formed between each of the corner forming tools 70, 72.

Figure 13:
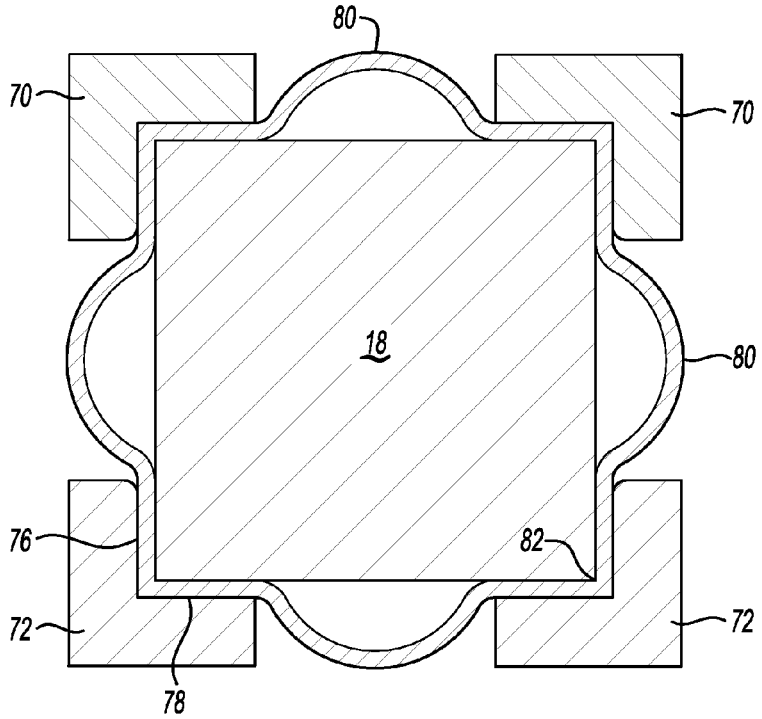
FIG. 13 is a cross-sectional view showing the embodiment of FIG. 11 with the pre-formed corner fully formed by the four forming tools to have a pre-formed corner and a bulge on each side between the corner.

Referring to FIG. 13, the bulges 80 facilitate forming sharp corners in the tubular member 12 when the pre-formed corners 82 are fully formed into the corner forming tools 70, 72. The bulges 80 are also shown to be more pronounced in FIG. 13. The pre-form as shown in FIG. 13 is ready to be placed in a hydroforming tool and hydroformed as described with reference to FIGS. 7 and 8 above.

Figure 14:
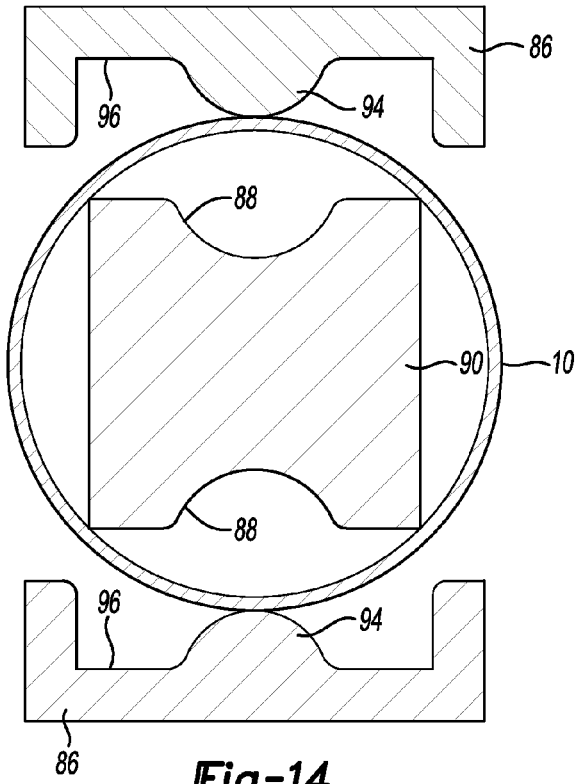
FIG. 14 is a cross-sectional view of an alternative embodiment in which a tubular blank has an alternative form of the inner mandrel with two forming tools in position to begin forming the tubular blank.

Referring to FIG. 14, another alternative embodiment is shown in which a tubular blank 10 is pre-formed with a pair of end corner forming tools 86. The end corner forming tools 86 form the tubular blank 10 into recesses 88 formed in an inner mandrel 90. The end corner forming tools 86 include arcuate protrusions 94 that form the tubular blank 10 into the recesses 88 of the inner mandrel 90. Corner forming recesses 96 form the tubular blank 10 in a manner similar to the corner forming tools 70, 72. It should be noted that the end corner forming tools 86 or the forming tools 70, 72 may be either both movable, or one may be movable relative to a stationary tool.

Figure 15:
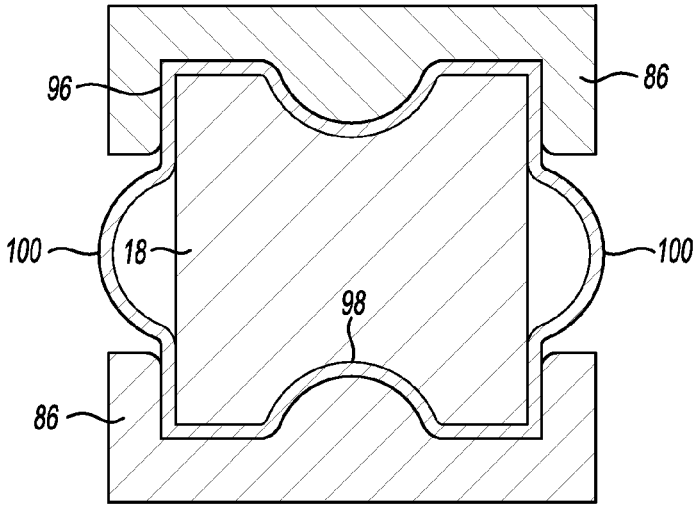
FIG. 15 is a cross-sectional view of the embodiment shown in FIG. 14 with the tubular blank fully formed to have pre-formed corners and two internal recesses and two external ribs on opposing sides of the inner mandrel.

Referring to FIG. 15, another alternative embodiment is shown with a fully formed pre-form formed between end corner forming tools 86 with internal recesses 98 formed by the end corner forming tools and external ribs 100 formed outboard of the sides of the mandrel that extend between the end corner forming tools 86. The corner forming recesses 96 form sharp corners in the pre-form.

Figure 16:
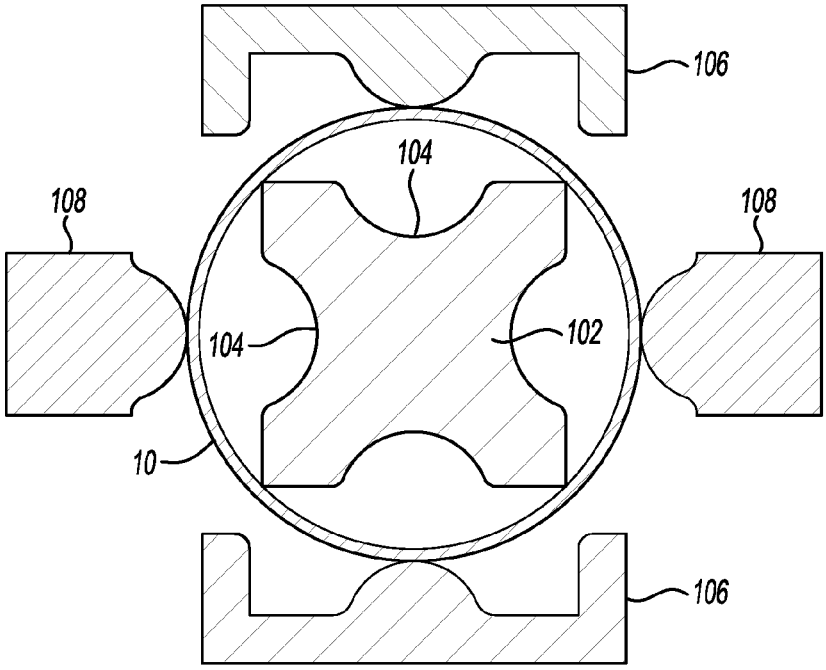
FIG. 16 is a cross-sectional view of another embodiment showing an internal mandrel having arcuate indentations on each side between the corners of the mandrel and showing four forming tools disposed about the pre-form tube.

Referring to FIG. 16, another alternative embodiment is shown in which a tubular blank 10 has a quad-recess inner mandrel 102 disposed within the tubular blank 10. The mandrel 102 includes a recess 104 formed in each of its four sides. End corner forming tools 106, that are like those described with reference to FIGS. 14 and 15 above, form the tubular blank 10 on opposite ends as described with reference to FIG. 15 above. Two punches 108 are shown outboard of the tubular blank 10. The punches 108 form the tubular blank into two of the recesses 104.

Figure 17:
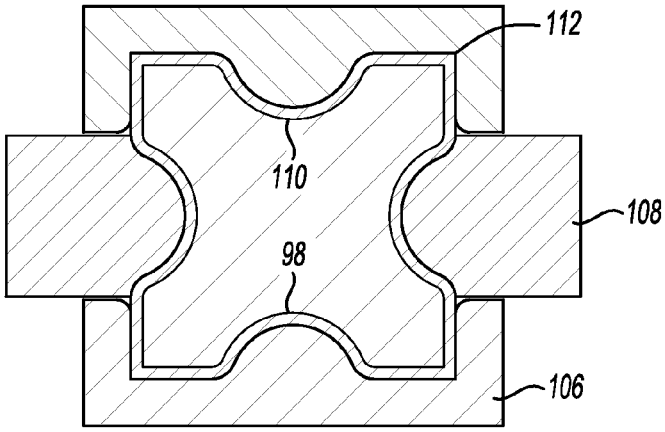
FIG. 17 is a cross-sectional view of the embodiment shown in FIG. 16 with the pre-formed tube being fully formed with four pre-formed corners and four indentations on the sides between each corner.

Referring to FIG. 17, the end corner forming tools 106 and punches 108 are shown with a fully formed pre-form having sharp pre-form corners 112 and internal recesses between each of the sharp pre-form corners 112.

Figure 18:
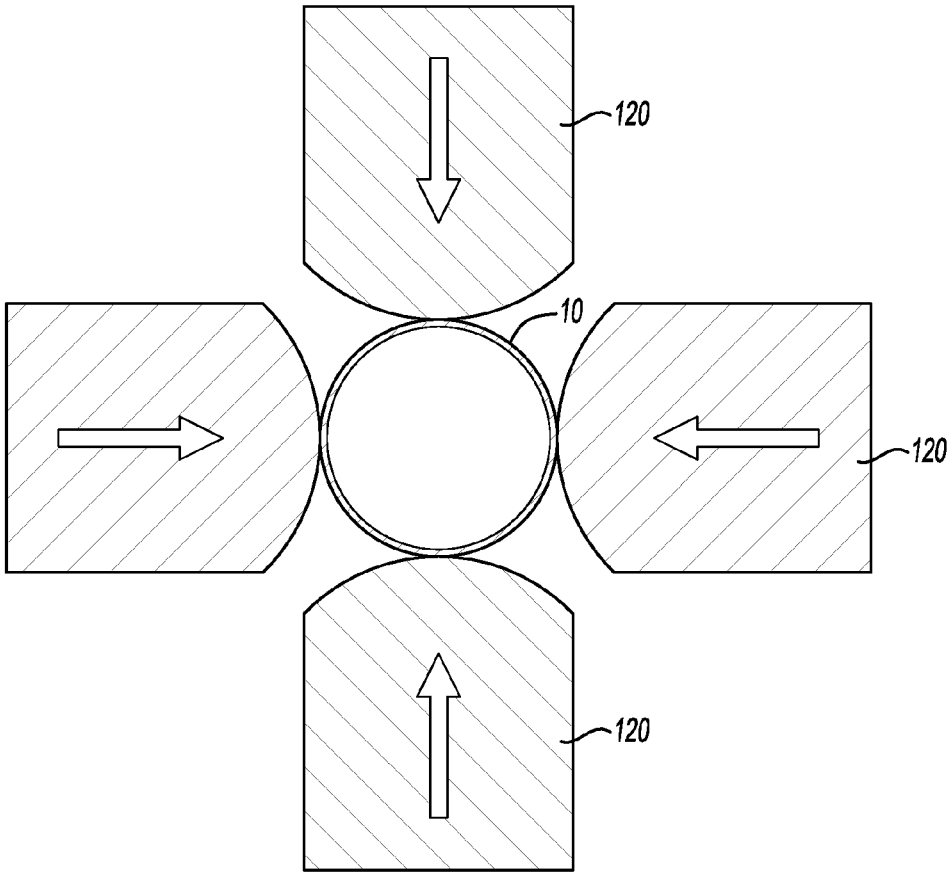
FIG. 18 is a cross-sectional view of another embodiment showing a tubular blank with four punches exposed about the tubular blank in position to compress the tubular blank from four different directions.

Referring to FIG. 18, another alternative embodiment is shown in which punches 120 engage the tubular blank 10 from four different directions. Some of the punches may be static, or all of the punches may converge upon the tubular blank 10, as indicated by the directional arrows in FIG. 18. In one alternative embodiment, two opposed punches may be active while two opposed punches are static.

Figure 19:
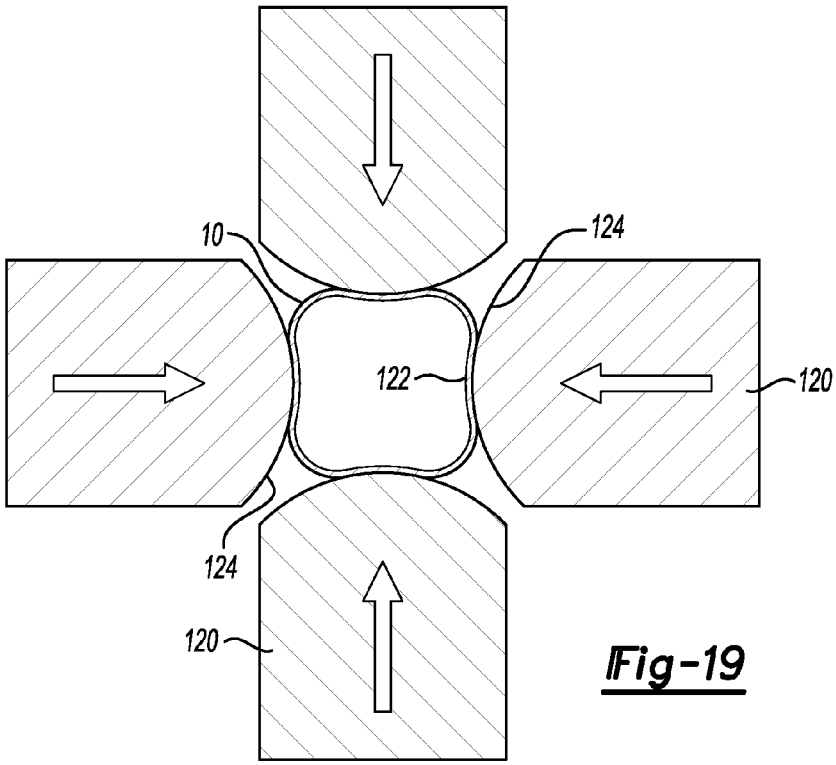
FIG. 19 is a cross-sectional view of the embodiment shown in FIG. 18 with the punches partially compressing the tubular blank.

Referring to FIG. 19, the punches 120 are used to form internal recesses 122 in the tubular blank 10. The punches each have a convex forming surface 124 that engages the tubular blank 10 to form the internal recesses 122.

Figure 20:
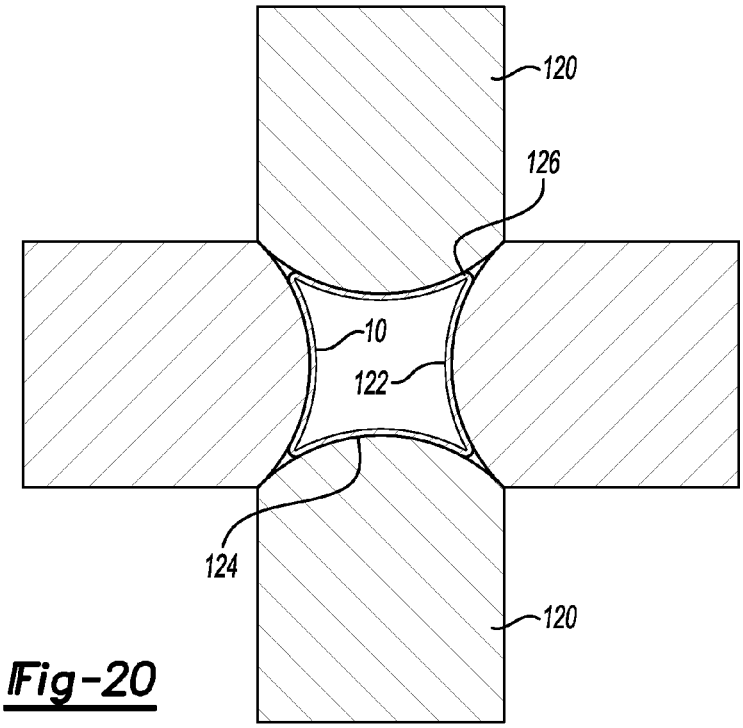
FIG. 20 is a cross-sectional view of the embodiment of FIG. 18 with the punches fully compressing the tubular blank to form a tubular pre-form having four pre-formed corners and a concave side between each corner.

Referring to FIG. 20, the tubular blank 10 is shown fully formed into a pre-form shape with sharp pre-form corners 126 being formed between the convex forming surfaces 124 of adjacent punches 120. The fully formed pre-form may be removed from the punches and formed in a hydroforming operation as described with references to FIGS. 7 and 8 above.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a tubular member to have a finished corner at an intended corner location next to an intended wall location, the method comprising:

selecting a tube;

compressing the tube with a plurality of punches to pinch the tube and form a pre-formed corner on the tube between two of the punches;

forming a bulge on the tube in the intended wall location;

placing the tube in a hydroforming tool;

expanding the tube to form the pre-formed corner into the finished corner at the intended corner location with material from the bulge flowing toward the intended corner location.

2. The method of claim 1 wherein the punches each have a curved surface that contacts the tube and wherein the curved surface of each punch forms at least one bulge.

3. The method of claim 2 wherein the curved surface is convex, and the four corners are formed to an inner angle that is less than 90 degrees.

4. The method of claim 1 wherein the tube selected is a cylindrical tube.

5. The method of claim 1 wherein the tube is a rectangular tube and in the compressing step four punches pinch the tube between two of the punches at four corners on the tube.

6. The method of claim 5 wherein two of the punches are driven toward each other in opposite directions and two of the punches remain stationary.

7. The method of claim 1 wherein the plurality of punches include a first punch moved toward the tube in a first direction, and a second punch moved toward the tube in a second direction that is opposite to the first direction to compress the tube and, a third punch moved toward the tube in a third direction, and fourth punch moved toward the third punch in a fourth direction that is perpendicular to the first direction and opposite to the third direction to compress the tube.

8. The method of claim 1 further comprising:

inserting a mandrel having an edge inside the tube;

forming the pre-formed corner on the tube against the edge; and removing the mandrel from the tube.

9. A method of forming a sharp corner in a tubular member comprising:

selecting a tubular blank;

inserting a mandrel having an edge inside the tubular blank forming a pre-form corner and a pre-form bulge in a pre-formed tubular blank, wherein the pre-form bulge is formed in a wall of the tubular blank adjacent to the pre-form corner;

placing the pre-formed tubular blank in a hydroforming tool;

expanding the pre-formed tubular blank to form the pre-form corner into the sharp corner with material from the bulge flowing toward the sharp corner;

forming the sharp corner on the tubular blank against the edge; and removing the mandrel from the tube before placing the pre-formed tubular blank in the hydroforming tool.

10. The method of claim 9 further comprising:

compressing the tubular blank with a plurality of punches to pinch the tubular blank and form the pre-form corner on the tubular blank between two of the punches;

forming the pre-form bulge on the tubular blank with the punches.

11. The method of claim 10 wherein the tubular member is a rectangular tube and in the compressing step four punches pinch the tube between two of the punches at four corners on the tube.

12. The method of claim 9 wherein during the step of inserting the mandrel inside the tubular blank only a portion of the tubular blank receives the mandrel.

13. A method of forming a tubular member to have a sharp corner at an intended corner location between two intended wall locations, the method comprising:

selecting a tube;

forming a pre-form corner on the tube;

forming a bulge on the tube in a pre-form wall location;

placing the tube in a hydroforming tool;

expanding the tubular member to form the corner into the intended corner location with material from the bulge flowing toward the intended corner location.

14. The method of claim 13 wherein the tube is cylindrical and the tubular member is polygonal.

15. The method of claim 13 wherein the step of expanding the tubular member is performed with a mandrel that includes a plurality of moving parts that may be moved relative to each other to extract the moving parts from the tube.

16. The method of claim 15 wherein a liquid is injected between the mandrel and the tube to expand the tube prior to removing the mandrel from the tube.

17. The method of claim 15 wherein during the step of inserting the mandrel inside the tube only a portion of the tube receives the mandrel.

18. The method of claim 13 further comprising:

inserting a mandrel having an edge inside the tube, wherein the pre-form corner is formed against the edge; and removing the mandrel from the tube.

* * * * *